US008651657B2

(12) United States Patent
Oraa et al.

(10) Patent No.: US 8,651,657 B2
(45) Date of Patent: Feb. 18, 2014

(54) PRINTER MODULE WITH BUMPER

(75) Inventors: Inigo Oraa, Guecho Vizcaya (ES); Felix Ruiz, Sant Cugat del Valles (ES); Jonathan Negro, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 383 days.

(21) Appl. No.: 12/909,339

(22) Filed: Oct. 21, 2010

(65) Prior Publication Data

US 2012/0098915 A1 Apr. 26, 2012

(51) Int. Cl.
*B41J 29/13* (2006.01)
*B41J 25/308* (2006.01)
*B41J 23/00* (2006.01)

(52) U.S. Cl.
USPC ..... 347/108; 347/8; 347/37

(58) Field of Classification Search
None
See application file for complete search history.

(56) References Cited

U.S. PATENT DOCUMENTS

| | | | | |
|---|---|---|---|---|
| 4,130,206 | A * | 12/1978 | Buccicone | 414/788.9 |
| 5,598,201 | A | 1/1997 | Stodder et al. | |
| 5,898,445 | A | 4/1999 | Becker et al. | |
| 6,182,566 | B1 * | 2/2001 | Kubatzki et al. | 101/93 |
| 7,136,606 | B2 | 11/2006 | Rose et al. | |
| 2003/0193530 | A1 * | 10/2003 | Blackman et al. | 347/2 |
| 2004/0213599 | A1 * | 10/2004 | Huffman et al. | 399/110 |
| 2007/0057428 | A1 * | 3/2007 | Luo | 271/9.01 |
| 2008/0238995 | A1 * | 10/2008 | Menendez et al. | 347/37 |
| 2009/0237425 | A1 * | 9/2009 | Lang | 347/7 |
| 2010/0244371 | A1 * | 9/2010 | Suh | 271/225 |

FOREIGN PATENT DOCUMENTS

JP 6024582 B 4/1994

* cited by examiner

*Primary Examiner* — Stephen Meier
*Assistant Examiner* — Alexander C Witkowski

(57) ABSTRACT

Printer module includes a media processing member and a bumper that is arranged to be adjusted in height to provide for a parallel arrangement of the media processing member with respect to a printer roller.

20 Claims, 5 Drawing Sheets

PRINTER MODULE WITH BUMPER

BACKGROUND

Many printers are provided with modules that open and close with respect to the printers. For example, a printer may be provided with a scanner, duplexer, folder, stacker, etc. that is connected to the printer by hinges. Such modules are sometimes also referred to as printer accessories. Typically, the manufacturer of the printer and the manufacturer of the module are different parties. Therefore, the module and the printer are assembled after both have been manufactured completely.

The printer modules are typically seen in large format printers. The modules are arranged for processing the large format media before, during and/or after printing. For example, a duplexer receives printed media from the printer after printing, flips the printed media, and inserts the printed media into the printer so that it may be printed on the other side. A scanner is arranged to scan the media. The media may be advanced along the scanner sensor by the printer rollers.

BRIEF DESCRIPTION OF THE DRAWINGS

The accompanying drawings illustrate various examples of the principles described herein and are a part of the specification. The illustrated examples are merely examples and do not limit the scope of the claims.

Throughout the drawings, identical reference numbers designate similar, but not necessarily identical, elements.

DETAILED DESCRIPTION

In the following detailed description, reference is made to the accompanying drawings. The examples in the description and drawings should be considered illustrative and are not to be considered as limiting to the specific example or element described. Multiple examples may be derived from the following description and/or drawings through modification, combination or variation of certain elements. Furthermore, it may be understood that other examples or elements that are not literally disclosed may be derived from the description and drawings by a person skilled in the art.

Figure 1:
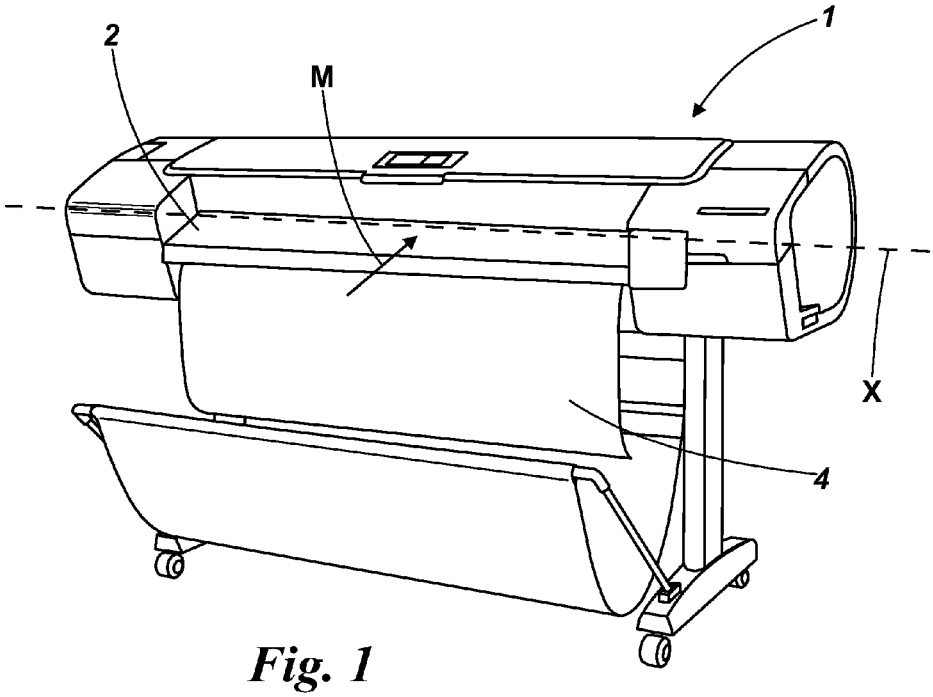
FIG. 1 shows an example of a large format printer with a module in diagrammatic perspective view.

FIG. 1 shows an example of a printer 1 comprising a module 2. The module 2 is attached to the printer 1, and may in this description be considered as a part of the printer 1. The module 2 comprises hinges 3 (FIG. 2) for hinging the module 2 with respect to the printer 1, around a hinge axis X. The hinge axis X may extend parallel to printer rollers 13. In the shown example, the printer 1 is a large format printer, suitable for printing images of at least 0.8 meters wide. The module 2 may be a scanner, duplexer, folder, cutter, stacker, or any other suitable printer module 2. The module 2 may be a printer accessory. The module 2 may be arranged for processing large format media before, after and/or during printing. In an example, the module 2 may weigh at least approximately 7 kilograms, at least approximately 10 kilograms, or at least approximately 15 kilograms. Due to the relatively heavy weight of a large format module 2, alignment of certain module examples with respect to the printer 1 may be a challenge.

Figure 2:
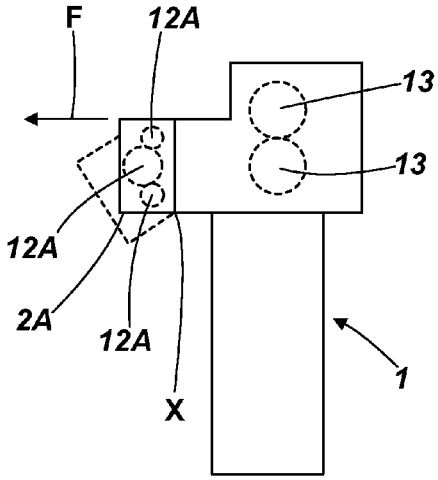
FIG. 2 shows a diagrammatic side view of an example of a printer with a duplexer module.
Figure 3:
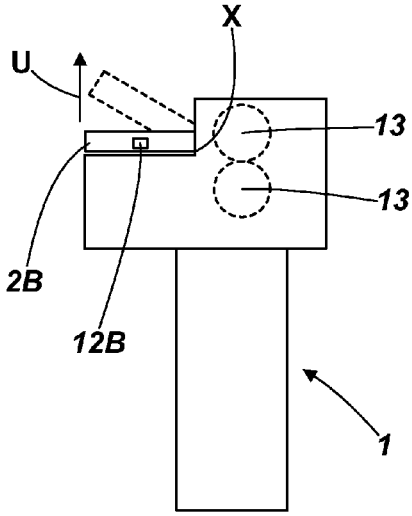
FIG. 3 shows a diagrammatic side view of an example of a printer with a scanner module.

As can be seen in FIGS. 2 and 3, the printer 1 is provided with rollers 13 perpendicular to a media advance direction M, for advancing the media 4 through the printer 1 and/or through the module 2, whereas the module 2 is provided with media processing members 12A, 12B parallel to the printer rollers 13, and/or to the hinge axis X.

FIG. 2 diagrammatically illustrates a printer 1 with a duplexer module 2A. The duplexer module 2A is provided with media processing members. In this example, the media processing members comprise rollers 12A to transport and flip the media 4 with respect to the printer 1. The duplexer rollers 12A extend parallel to the printer rollers 13. A parallel arrangement of the duplexer rollers 12A and the printer rollers 13 prevents media skew and/or paper jams. In the shown example, printer 1 is arranged to open the duplexer module 2A in a forward direction F about hinge axis X. In an example, the hinges 3 of the module 2 are biased in a direction for opening the module 2 with respect to the printer 1, for example by a resilient actuator such as a torsion spring. The module 2 comprises a latch member for retaining the module 2 in a closed condition, against the printer 1.

In another example, a scanner module 2B is provided, as illustrated in FIG. 3. The scanner module 2B also comprises a media processing member. The media processing member comprises an image scan sensor 12B. The image scan sensor 12B may comprise a longitudinal sensor array. The image scan sensor 12B may comprise a contact image sensor (CIS) or a charge-coupled device (CCD). The image scan sensor 12B is arranged parallel to the printer rollers 13 so that the media 4 may be scanned along the full width and without skew. In an example the media 4 is scanned while being transported by the rollers 13 of the printer 1. The scanner 2B may comprise further media processing members such as passive rollers. The straight image may subsequently be printed without image skew by the printer 1. In the shown example, the printer 1 is arranged to open the scanner module 2B in an upward direction U.

In certain examples, the media processing members 12A, 12B of the respective module 2 may comprise a knife, folder parts, a media stacker, etc. A parallel arrangement of the media processing members of the module 2 with respect to the rollers 13 of the printer 1 may prevent incorrect processing of the media 4 by the printer 1 or module 2.

Figure 4:
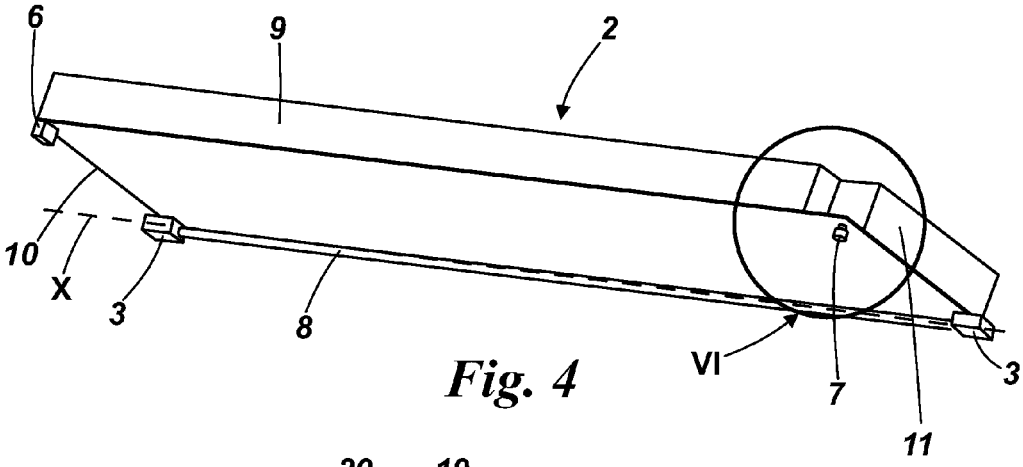
FIG. 4 shows a diagram of an example of a module in perspective view.

FIG. 4 shows a printer module 2, suitable for connection to a printer 1. The shown module 2 comprises a large format printer module for processing large format media 4. In the shown example, the module 2 has four support points consisting of two hinges 3 and two engaging members 6, 7 for engaging the printer 1.

The engaging members 6, 7 are provided near a distal edge 9 of the module 2, at a distance from the hinge axis X. The distal edge 9 of the module 2 is the edge that is opposite to the hinge edge 8. The engaging members comprise a fixed engaging member arranged near a first side edge 10, and an adjustable engaging member arranged near a second side edge 11 opposite to the first side edge 10. In the shown example, the fixed engaging member comprises a latch member 6 and the second engaging member comprises an adjustable bumper 7. In certain examples, the fixed engaging member comprises a fixed height bumper or foot.

In other examples, the first fixed engaging member is arranged near the middle of the distal edge 9, while the adjustable engaging member may be arranged near one or both side edges 10, 11. For example, one or two adjustable bumpers 7 may be arranged near one or both side edges 10, 11. In one example, the distance between the adjustable bumper 7 and the fixed engaging member is at least approximately 0.4 meters.

The adjustable bumper 7 is arranged to engage the printer 1 in a closed condition of the module 2. In the shown example, the bumper 7 is adjustable in height. As apparent from FIGS. 5 and 6, the bumper 7 may comprise a widely available bumper screw 17 with a resilient foot 18. The foot 18 may comprise elastomeric material. The bumper may consist of a set of parts, including a resilient foot 18, a screw 17 and a nut 19. In the art, the bumper 7 may be referred to as shock absorption stopper or screw rubber. The bumper 7 comprises resilient material for providing a shock absorption effect to decrease an impact when the module 2 is hinged against the printer 1. When the module 2 is closed, the foot 18 partly supports the module 2, in addition to the hinges 3 and fixed engagement member 6. A load force may press against the foot 18 causing a displacement of the resilient material of the foot 18.

The adjustable bumper 7 may prevent deformation of the module 2. Currently, deformation of the module 2 can for example occur when there is no support or an incorrect support near a side edge 10, 11 of the module 2. Such deformation may, directly or indirectly, be caused by a weight of the module itself, and/or by extra weights being put on the module, for example because certain articles are placed onto the module or by people leaning onto the module. Furthermore, deformations in the module may be caused by temperature changes, impacts, vibrations in the room, etc. Deformations tend to occur during transport or usage. There is a risk that a parallel alignment of the media processing members 12 and the printer rollers 13 is lost so that issues such as media skew, media jams and media damage may occur.

The adjustable bumper 7 is arranged to be adjusted in height to arrange the media processing member and the printer roller 13 in parallel. First, the bumper 7 provides for a support where otherwise there may not have been support. Secondly, the bumper 7 is purposely set to be higher if a pressure on the bumper 7 is higher. The pressure on the bumper 7 may depend on the type and/or weight of the module 2 and/or the way it is attached to the printer 1. For a proper parallel arrangement, the height of the bumper 7 may be set to compensate for a displacement of the bumper 7 in a closed condition of the module 2, for example caused by a load force.

Figure 5:
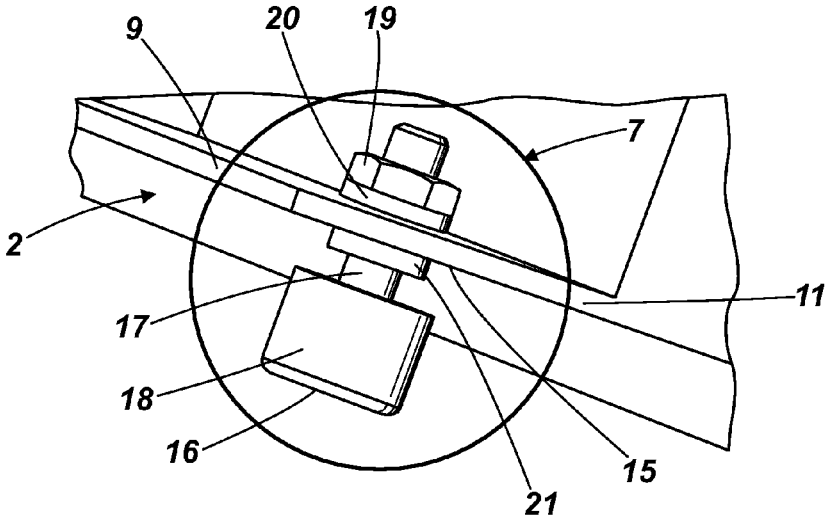
FIG. 5 shows a perspective, detailed view of an example of the module of FIG. 4 with a bumper.
Figure 6:
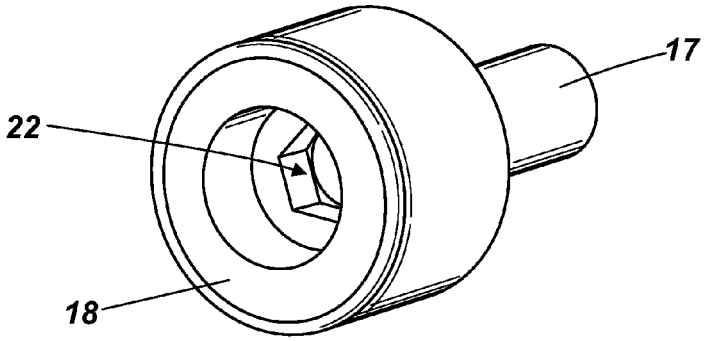
FIG. 6 shows a perspective view of an example of a bumper screw.
Figure 7:
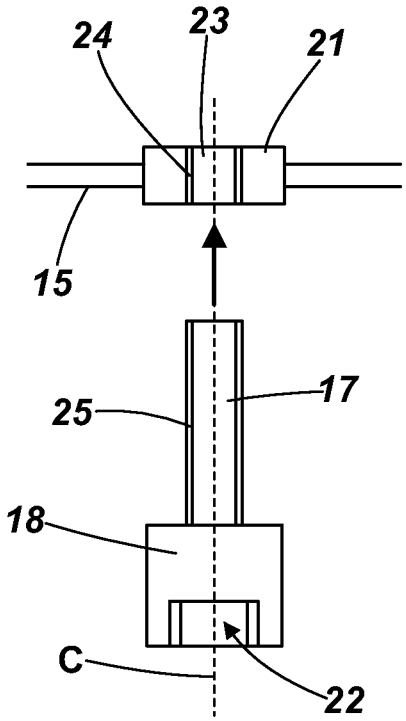
FIG. 7 shows a detailed, diagrammatic, cross-sectional front view of an example of a bumper screw and a module base in a first stage.
Figure 8:
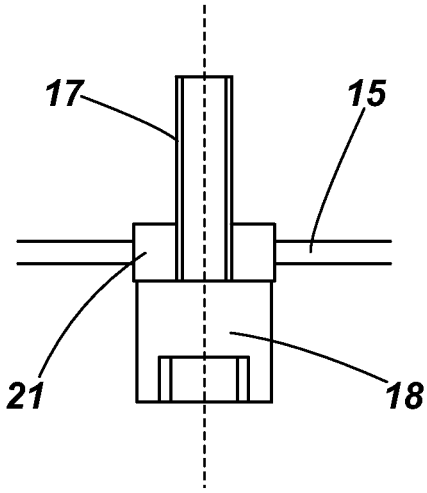
FIG. 8 shows a detailed, diagrammatic, cross-sectional front view of the example of the bumper screw and module base corresponding to FIG. 7, in a next stage.

As can be seen from FIGS. 5 and 6, in an example the adjustable bumper 7 is attached to the module 2, near a corner near the second side edge 11 and the distal edge 9, as can be seen from FIG. 5. The module 2 comprises a base 15. The bumper 7 is attached to the base 15. For example, the base 15 may be a plate or frame of the module 2. The bumper 7 has a distal end 16, formed by the end of the foot 18. The height of the bumper 7 is measured from the surface of the base 15 to the distal end 16 of the bumper 7. The height of the preset bumper 7 varies according to the pressure being applied onto the bumper 7.

To adjust the height of the bumper 7 during assembly, an example of the bumper 7 comprises a set of widely available parts. In the shown example, the bumper 7 comprises a screw 17, an elastomeric foot 18 and a separate nut 19 for attachment to the screw 17 opposite to the foot 18. The nut 19 may be designed to be tightened by a spanner, wrench, key or other suitable tool. The bumper 7 may further comprise a washer 20. The base 15 comprises a hole with screw thread for attaching the screw 17. A clinch nut 21 may be used for providing the hole with screw thread in the base 15. The clinch nut 21 may be pressed into or otherwise attached to the base 15. As can be seen from FIG. 6, the bumper 7 may comprise a screw head 22. The screw head 22 may be designed to fit an Allen key, screw driver or another suitable tool. By turning the screw 17 in the base 15 the height of the bumper 7 can be set. By tightening the nut 19 with respect to the screw 17, the bumper 7 is tightened to the base 15. The bumper 7 may be heightened by turning the screw head 22 while holding the nut 19. The bumper 7 may be tightened by turning the nut 19 while holding the screw head 22.

FIGS. 7-14 represent respective phases in a method of arranging printer module 2 and a printer 1 in parallel, including setting the height of the adjustable bumper 7 to the module 2. In the example shown in FIG. 7, a clinch nut 21 is provided in the base 15. The clinch nut 21 comprises a through hole 23 with a screw thread 24, around a central axis C. The bumper 7 comprises a screw 17 having a corresponding screw thread 25, an elastomeric foot 18, and a screw head 22. The screw 17 is inserted in the clinch nut 21 along the central axis C. In a first phase, the screw 17 is turned into the base 15, for example until the foot 18 engages the clinch nut 21 or base 15, as can be seen from FIG. 8.

Figure 9:
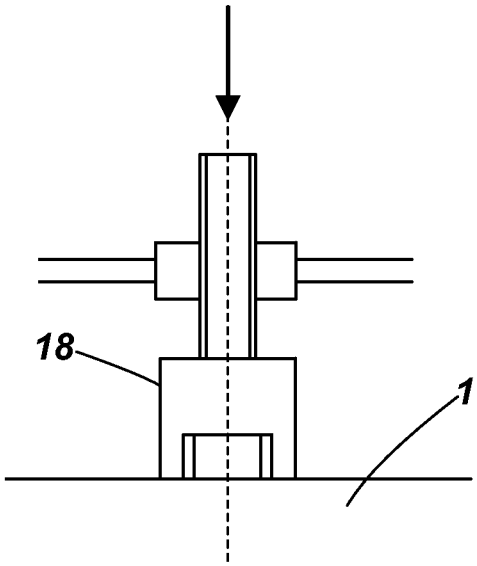
FIG. 9 shows a detailed, diagrammatic, cross-sectional front view of the example of the bumper screw and module base corresponding to FIGS. 7 and 8, in a next stage.

Thereafter the screw 17 is turned until the foot 18 touches the printer 1 but with little or no pressure on the foot 18, as shown in FIG. 9. The height of the bumper 7 is set at a distance between the module 2 and the printer 1 when the module 2 is closed. To set such height, the module 2 may need to be occasionally opened and closed. The screw 17 may be turned by an Allen key or another suitable tool. The module 2 may be occasionally opened for turning the screw 17 with the key, and closed for verification if the bumper 7 touches the printer 1. In a closed condition, the latch member 6 may latch itself in the corresponding printer latch member for locking the module 2 to the printer.

Figure 10:
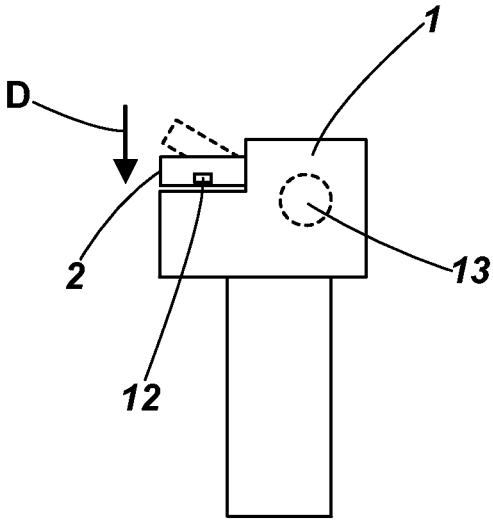
FIG. 10 shows a diagrammatic side view of an example of a printer with module corresponding to FIGS. 7-9, in a next stage.

In one example, the module 2 is closed in a downward direction D (see FIG. 10). In another example, such as the example of FIG. 2, the module 2 could for example be closed in a backwards direction. In the closed condition of FIG. 10, the media processing member 12 in the module 2 extends parallel to the printer rolls 13. However, still the module 2 may be susceptible to deformation because a displacement factor of the resilient foot 18 is not taken into account. A displacement may follow because of the pressure on the bumper 7 in a closed condition of the module 2. The pressure onto the bumper 7 results from a load or push force of the module 2 onto the bumper 7.

Figure 11:
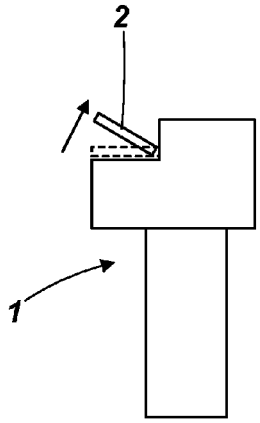
FIG. 11 shows a diagrammatic side view of and example of the printer with module corresponding to FIGS. 7-10, in a next stage.
Figure 12:
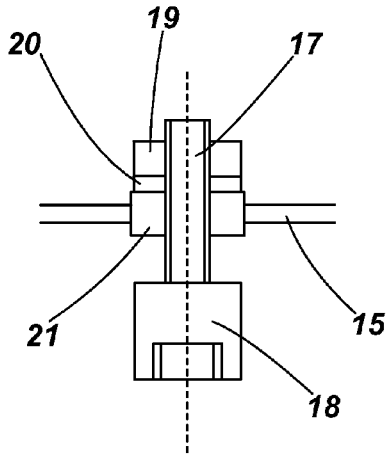
FIG. 12 shows a detailed, diagrammatic, cross-sectional front view of an example of a bumper set and module base corresponding to FIGS. 7-11, in a next stage.

Referring to FIG. 11, the module 2 is opened. Referring to FIG. 12, the nut 19 is turned onto the screw 17. Also a washer 20 may be turned onto the screw 17, between the nut 19 and the base 15. The nut 19 is turned but not tightened to the screw 17. The screw 17 is held while the nut 19 is turned. The screw 17 may be held by holding the Allen key or any other suitable tool in the screw head 22. The nut 19 may be turned by a wrench, or any other suitable tool.

Figure 13:
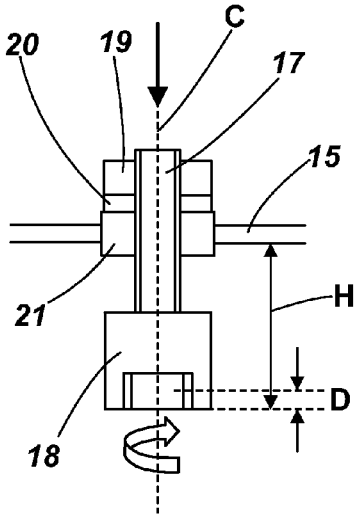
FIG. 13 shows a detailed, diagrammatic, cross-sectional front view of the example of the bumper set and module base of FIGS. 7-12, in a next stage.

Referring to FIG. 13, the screw 17 is turned with the Allen key or another tool while the nut 19 is retained, thereby increasing the height H of the bumper 7 with a displacement distance D. The displacement distance D is the displacement of the bumper 7 that occurs, or that is estimated to occur, because of the pressure onto the bumper 7 in a closed condition of the module 2. After increasing the height H by the displacement distance D, the total height H of the bumper 7 may equal the distance between the base 15 and the printer 1 in a closed condition of the module 2, when the media processing members 12 and printer rollers 13 are parallel, plus the displacement D of the bumper 7 in a closed condition of the bumper 7, as measured along the central axis C of the bumper 7.

Figure 14:
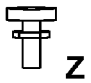
FIG. 14 shows a graph plotting the load force on an example of a bumper versus the displacement of the bumper.
Figure 14:
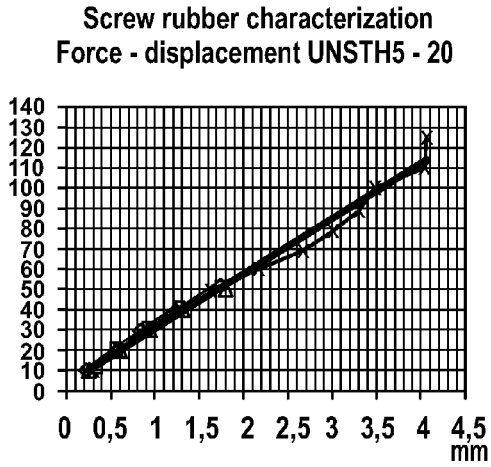

FIG. 14 represents a table characterizing force versus displacement of a specific example of a bumper 7 which may be referred to as UNSTH5-20. In an example, the displacement distance D of the foot 18 is estimated by first measuring a load on the foot 18, in a closed and parallel condition of the module 2, and retrieving the corresponding displacement from a table plotting load force versus displacement for the foot 18, as illustrated by FIG. 14. The load or pressure on the bumper 7 may be measured by providing a flat load sensor between the foot 18 and the printer 1. Depending on the type of module 2, the load may also be calculated by measuring a weight of the module 2 and dividing it by the number of supports. On other examples, the displacement D of the bumper 7 may be determined by measuring it. Furthermore, a determined displacement distance D may be determined one time only, and thereafter by applied to similar bumpers 7 and modules 2.

Figure 15:
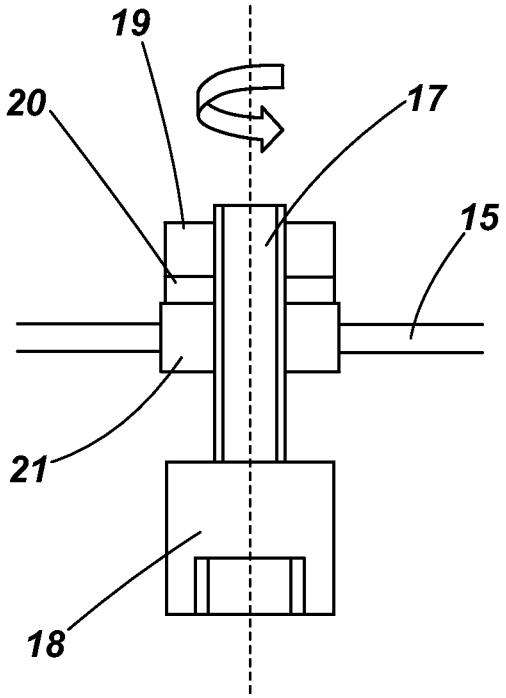
FIG. 15 shows a detailed, diagrammatic, cross-sectional front view of the example of the bumper set and module base corresponding to FIGS. 7-13, in a next stage.

Referring to FIG. 15, after having said the final height H the screw 17 is tightened by holding the screw 17, for example with said Allen key or another suitable tool, and tightening the nut 19, for example by said wrench or other suitable tool. This maintains the height of the foot 18.

The resulting printer 1 may comprise a module 2 of which the media processing members 12 are arranged parallel to the printer rollers 13, also after relatively long periods of usage. The bumper 7 may provide an adapted support, preventing deformations in the module 2 with respect to the printer 1. The bumper 7 arrangement and assembly method may be applied for a wide range of modules 2 and printers 1.

In an example, the adjustable bumper 7 allows for easy assembly of the module 2 by the printer, the module manufacturer, or a third party. The adjustable bumper 7 may provide for a general solution to all or most kinds of printer modules 2. Certain examples of the bumper 7 comprise standard parts, so that the adjustable bumper 7 may be readily assembled to the module 2 by printer manufacturers, module manufacturers or third party manufacturers, and for example at the end user site. The adjustable bumper 1 may be applied to existing printers 1. The adjustable bumper 7 provides for a relatively simple solution while improving the reliability and durability of printer modules 2 wherein image and media defects may be largely prevented.

In one aspect, a printer 1 may be provided, comprising a printer roller 13, a module 2 comprising a media processing member 12, a hinge 3 for hinging the module 2 with respect to the printer 1, and engaging members 6, 7 attached near a distal edge 9 of the module 2 opposite to the hinge 3, for supporting the module 2 against the printer 1. At least one of the engaging members 6, 7 may comprise a bumper 7 that is arranged to be adjusted in height, and the height of the bumper 7, as measured with respect to a base 15 to which it is connected, is set to provide for a parallel arrangement of the media processing member 12 with respect to the printer roller 13. In a further example, the height of the bumper 7, in an open condition of the module 2, equals the distance between the base 15 and the printer 1, in a closed condition of the module 2 and a parallel arrangement of the media processing member 12 and the printer roller 13, plus a displacement D of the bumper 7 caused by pressure on the bumper 7 in a closed condition of the module 2, after assembly of the bumper 7, wherein the distance and displacement D are measured along a central axis C of the bumper 7. In an example, the adjustable bumper 7 comprises a screw 17, an elastomeric foot 18 and a nut 19 for tightening the screw 17 to the base 15, and the base 15 of the module 2 comprises screw thread 24 for receiving the screw 17. In an example, a clinch nut 21 is provided through the base 15 for providing said screw thread 24. In a further example, one of the engaging members 6 has a fixed height. This engaging member 6 is for example another bumper or a latch member 6. In again a further example, the adjustable bumper 7 is arranged near a side edge 11 of the module 2. In an example, the printer 1 may be a large format printer having a print width of at least 0.8 meters. The module 2 may weigh at least approximately 7 kilograms. The module 2 may span at least approximately 0.4 meters without contacting the printer 1 between two engaging members 6, 7. A hinge axis X that extends between the module 2 and the printer 1, may extend parallel to a print roll 13 of the printer 1.

In a further aspect, a method of arranging a printer and a printer module 2 in parallel may be provided. The module 2 may comprise a media processing member 12 and an engaging member 6, 7. The module 2 may be arranged to hinge with respect to the printer 1. In an example, the method comprises (i) attaching the adjustable bumper 7 to the module 2, at a distance from the engaging member 6, and (ii) arranging the media processing member 12 of the module 2 and a printer roller 13 in parallel by adjusting a height of the bumper 7 with respect to its base 15. The method may comprise setting the height of the bumper 7, in an open condition of the module 2, based on the height of the bumper 7, when the module is closed, plus a displacement D of the bumper 7, caused by pressure on the bumper 7 when the module 2 is closed. In a further example, the load force on the bumper is determined, and the displacement distance of the bumper 7 is retrieved from predetermined data plotting the displacement D of the bumper 7 versus an applied load force to the bumper 7. In again a further example, the bumper 7 may comprise a screw 17 and an elastomeric foot 18, and the method comprises (i) providing a through hole 23 with screw thread 24 in a base 15 of the module 2, (ii) turning the screw 17 in the through hole 23 to increase the height of the bumper 7, until the foot 18 touches the printer 1 in a closed condition of the module 2, with little or no pressure on the foot 18, (iii) increasing the height of the foot 18 with respect to the base 15 by the displacement distance D, and (iv) tightening a nut 19 with respect to the screw 17 while maintaining the height of the foot 18. In again a further example, (i) a washer 20 and the nut 21 are attached to the screw 17 without being tightened, (ii) the nut 21 is held while turning the screw 17 for increasing the height of the foot 18 with respect to the base 15 by the displacement distance D, and (iii) the nut 21 is tightened while holding the screw 17.

In again a further aspect, large format printer module 2 is provided, for attachment to a large format printer 1. The module 2 may have a hinge edge 8, a distal edge 9 opposite to the hinge edge 8, and two opposite side edges 10, 11. In an example, the module 2 weighs at least approximately 7 kilograms. The module 2 may comprise hinge portions 3 near the hinge edge 8, an engaging member 6 near the distal edge 9, a bumper set 7 near a side edge 11 and the distal edge 9, screwed into a base 15 of the module 2, wherein the distance between the bumper set 7 and the engaging member 6 is at least approximately 0.4 meters, the bumper set 7 comprises a screw 17, an elastomeric foot 18 and a separate nut 21 for attachment to the screw 17 opposite to the foot 18, and the bumper set 7 is arranged to set the height of the foot 18 with respect to the base 15.

The above description is not intended to be exhaustive or to limit the invention to the examples disclosed. Other variations to the disclosed examples can be understood and effected by those skilled in the art from a study of the drawings, the disclosure, and the appended claims. For example, mechanical inversion may be applied to the example shown and discussed. The adjustable bumper 7 may be attached to the printer 1, instead of to the module 2. The indefinite article "a" or "an" does not exclude a plurality, while a reference to a certain number of elements does not exclude the possibility of having more elements. A single unit may fulfill the functions of several items recited in the disclosure, and vice versa several items may fulfill the function of one unit.

In the following claims, the mere fact that certain measures are recited in mutually different dependent claims does not indicate that a combination of these measures cannot be used to advantage. Multiple alternatives, equivalents, variations and combinations may be made without departing from the scope of this specification.

The preceding description has been presented only to illustrate and describe examples of the principles described. This description is not intended to be exhaustive or to limit these principles to any precise form disclosed. Many modifications and variations are possible in light of the above disclosure.

What is claimed is:

1. A printer module for connection to a printer comprising a printer roller, said printer module comprising:

a media processing member for exchanging print media with said printer, wherein said printer, separate from said module, prints images on said print media, a hinge for hinging the module with respect to the printer, and engaging members attached near a distal edge of the module opposite to the hinge, supporting the module with respect to the printer, wherein at least one of the engaging members comprises a bumper that is arranged to be adjusted in height, and the height of the bumper, as measured with respect to a base to which it is connected, is set to provide for a parallel arrangement of the media processing member with respect to the printer roller.

2. The printer module according to claim 1, wherein the height of the adjustable bumper, in an open condition of the module, equals the distance between the base and the printer, in a closed condition of the module and a parallel arrangement of the media processing member and the printer roller, plus a displacement of the adjustable bumper caused by pressure on the adjustable bumper in a closed condition of the module, after assembly of the adjustable bumper, wherein the distance and displacement are measured along a central axis of the adjustable bumper.

3. The printer module according to claim 1, wherein the adjustable bumper comprises a screw, an elastomeric foot and a nut for tightening the screw to the base, and the base of the module comprises screw thread for receiving the screw.

4. The printer module according to claim 3, wherein a clinch nut is provided through the base for providing said screw thread.

5. The printer module according to claim 1, wherein another one of the engaging members has a fixed height.

6. The printer module according to claim 1, another one of the engaging members comprises a latch portion.

7. The printer module according to claim 1, wherein the adjustable bumper is arranged near a side edge of the module.

8. The printer module according to claim 1, wherein the printer is a large format printer having a print width of at least 0.8 meters, the module weighs at least approximately 7 kilograms, the module spans at least approximately 0.4 meters without contacting the printer between two engaging members, and a hinge axis between the module and the printer extends parallel to a print roll of the printer.

9. The printer module according to claim 1, wherein the hinge is biased in a direction for opening the module with respect to the printer.

10. The printer module according to claim 1, wherein the module comprises a duplex module for receiving print media from the printer with printing on one side of the media and reversing the print media for subsequent printing on an opposite side of the media.

11. The printer module according to claim 1, wherein the module comprises a folder for folding print media received from the printer.

12. The printer module according to claim 1, wherein the module comprises a cutter for cutting print media received from the printer.

13. The printer module according to claim 1, wherein the module comprises a scanner.

14. Method of a method of arranging a printer and a printer module in parallel, wherein the module comprises a media processing member and an engaging member and is arranged to hinge with respect to the printer, comprising attaching the bumper to the module, at a distance from the engaging member, and arranging the media processing member of the module and a printer roller in parallel by adjusting a height of the bumper with respect to its base.

15. Method according to claim 14, comprising setting the height of the bumper in an open condition of the module, based on the height of the bumper when the module is closed plus a displacement of the bumper caused by pressure on the bumper when the module is closed.

16. Method according to claim 15, comprising determining the load force on the bumper, and retrieving the displacement distance from predetermined data plotting the displacement of a bumper versus an applied load force to the bumper.

17. Method according to claim 14, wherein the bumper comprises a screw and an elastomeric foot, the method comprising providing a through hole with screw thread in a base of the module, turning the screw in the through hole to increase the height of the bumper, until the foot touches the printer in a closed condition of the module, with little or no pressure on the foot, increasing the height of the foot with respect to the base by the displacement distance, and tightening a nut with respect to the screw while maintaining the height of the foot.

18. Method according to claim 17, comprising attaching a washer and the nut to the screw without tightening, holding the nut while turning the screw for increasing the height of the foot with respect to the base by the displacement distance, and tightening the nut while holding the screw.

19. Method according to claim 14, wherein the printer is a large format printer, having a print width of at least 0.8 meters, the hinge axis extends parallel to a print roll, the module weighs at least approximately 10 kilograms, and the image scanner comprises a latch spaced at least 0.4 meters away from the bumper.

20. Large format printer module for attachment to a large format printer, having a hinge edge, a distal edge opposite to the hinge edge, and two opposite side edges, comprising hinge portions near the hinge edge, an engaging member near the distal edge opposite the hinge edge, a bumper set near a side edge and the distal edge, screwed into a base of the module, wherein the distance between the bumper set and the engaging member is at least approximately 0.4 meters, the bumper set comprises a screw, an elastomeric foot and a separate nut for attachment to the screw opposite to the foot, and the bumper set is arranged to set the height of the foot with respect to the base.

* * * * *